United States Patent [19]

Di Luco

[11] Patent Number: 4,610,555

[45] Date of Patent: Sep. 9, 1986

[54] UNIVERSAL RIBBON SPOOL FOR TYPEWRITERS AND OTHER MACHINES

[76] Inventor: Eugene Di Luco, 1760 Miriam St., North Brunswick, N.J. 08902

[21] Appl. No.: 683,928

[22] Filed: Dec. 20, 1984

[51] Int. Cl.[4] ..... B65H 75/02

[52] U.S. Cl. ..... 400/243; 242/71.8

[58] Field of Search ..... 400/243, 242, 244, 245, 400/246; 242/71.8

[56] References Cited

U.S. PATENT DOCUMENTS

| | | | |
|---|---|---|---|
| 1,991,435 | 2/1935 | Walter | 242/71.8 |
| 2,925,164 | 2/1960 | Murphy | 400/243 |
| 3,042,180 | 7/1962 | Bishop | 400/243 |
| 3,807,544 | 4/1974 | Glover | 400/243 |
| 4,002,309 | 11/1977 | Ruiz-Barbotteau | 242/71.8 |
| 4,210,296 | 7/1980 | Frechette | 400/280.1 X |

FOREIGN PATENT DOCUMENTS

| | | | |
|---|---|---|---|
| 888762 | 12/1943 | France | 400/242 |
| 433354 | 8/1935 | United Kingdom | 242/71.8 |

*Primary Examiner*—Charles A. Pearson
*Attorney, Agent, or Firm*—Daniel H. Bobis

[57] ABSTRACT

A universal typewriter ribbon spool comprises a base member including a first flange member, and a centrally disposed annular hub having an inner wall and an outer wall, the inner wall defining an opening extending end-to-end therethrough; four splines equidistantly secured about the outer wall; four posts equidistantly secured about the inner wall and each having a longitudinal aperture therein; an annular ribbon holder having an inner wall defining an opening extending end-to-end therethrough and positioned about the hub; four splines equidistantly secured about the inner wall of the ribbon holder and which engage with the splines on the hub to prevent rotation of the ribbon holder about the hub; a resilient spool adapter positioned within the hub and formed of opposing arcuate gripping members which grip opposing posts of the hub, and a resilient center section having a central aperture, the center section connecting the gripping members together and being spaced from the remaining two posts when positioned within the hub; a second flange member; and four pins secured to the second flange member and which are inserted with a friction fit within the apertures of the posts to fixedly connect the second flange member to the base member such that the first and second flange members are disposed in generally spaced, parallel relation in assembled position on the spool.

1 Claim, 11 Drawing Figures

UNIVERSAL RIBBON SPOOL FOR TYPEWRITERS AND OTHER MACHINES

BACKGROUND OF THE INVENTION

This invention relates generally to ribbon spools and, more particularly, is directed to a universal typewriter ribbon spool.

Generally, typewriter ribbon spools for the various brands of typewriters are each constructed differently. The reason for such differences resides basically in the mechanism used on the typewriter for engaging the spool. Generally, all typewriters utilize a central spindle which is coaxially aligned within the spool by tabs that engage respective spaced apertures in one of the flange members of the spool. However, with different brands, the tabs are spaced differently, and even the spindles are constructed with different diameters. An example of one such typewriter that uses such spools is the Underwood Typewriter.

Another arrangement that is used by Olivetti employs a threaded spindle inserted coaxially within the spool and a nut arrangement at the opposite side of the spool for threadedly engaging with the spindle. This design also has a plurality of the aforementioned spaced tabs which engage within respective apertures in the flange member at the side of the nut arrangement. With this latter arrangement, the spindle is constructed with a different diameter than those of the aforementioned typewriter designs.

Accordingly, a manufacturer of spools for different typewriters must necessarily provide different molds and dies for making the different spools. This is costly and inefficient.

It has therefore been proposed to provide a universal spool which can be used with a plurality of different styles of typewriters.

For example, U.S. Pat. No. 3,042,180 discloses a universal typewriter ribbon spool having an insert or adapter mounted within the central hub thereof. According to the second embodiment of this patent, the adapter is formed with four arms which carry four arcuate sections, respectively, forming a cylindrical split sleeve coaxially positioned in the adapter. The arms and sections terminate at their upper ends in a common plane positioned at about one-third the distance down from the upper end of the side wall of the adapter and terminate at their lower end slightly above the lower end of the side wall. With this embodiment, the sections frictionally receive a spindle, referred to as the S type in the patent. For reduced diameter spindles which are not frictionally engaged by the sections, that is, for type S″ spindles described in the patent, a nut is threaded down on the threaded top of the spindle S″ such that the upper portion of the nut exerts a downward pressure on the upper side of the top closure of the spool.

U.S. Pat. No. 2,873,839 also discloses resilient arms as part of the insert of a universal typewriter ribbon spool having arcuate sections at the free ends thereof which are coaxially positioned within the insert for frictionally engaging the spindle.

U.S. Pat. No. 3,819,027 also discloses a multiple utility ribbon spool having an insert which can be used with various spindles.

In U.S. Pat. No. 3,833,109, a rolled tubular hub or sleeve about which the ribbon is wrapped is positioned over the hub of the spool, the latter having edges to maintain the rolled tubular hub thereon in a fixed relation. In a like manner, U.S. Pat. No. 2,476,928 uses a keyway and key arrangement to fix the sleeve on the central hub.

Other patents relating generally to the subject matter of the present invention, but far less pertinent than those discussed above, include U.S. Pat. Nos. 1,991,435; 2,925,164; 3,045,800; 3,094,204; 3,295,655; and 3,807,544.

The present invention is designed to provide a novel universal typewriter ribbon spool which differs structurally from the aforementioned spools and provides an advantageous assembly thereover.

OBJECTS AND SUMMARY OF THE INVENTION

Accordingly, it is an object of the present invention to provide a universal typewriter ribbon spool of the type having a resilient adapter therein.

More particularly, it is an object of the present invention to provide a universal typewriter ribbon spool in which the connecting structure for securing the closure member to the hub of the spool is in operative engagement with the resilient adapter.

It is another object of the present invention to provide a universal typewriter ribbon spool that is relatively simple and economical to manufacture and use.

In accordance with the present invention, a universal spool for ribbons comprises a base member including a first flange member, and a centrally disposed annular hub having an inner wall and an outer wall, the inner wall defining an opening extending end-to-end therethrough; spline means disposed on the inner wall of said hub; first connector means secured to the inner wall; an annular ribbon holder having an inner wall defining an opening extending end-to-end therethrough and positioned about the outer wall of the hub; restraining means secured to the inner wall of the ribbon holder for engaging with the spline means to prevent rotation of the ribbon holder about the hub; resilient spool adapter means having a central opening and positioned within the opening of the hub in operative engagement with the first connector means; a closure member including, a second flange member, and second connector means secured to the closure member for matingly engaging with the first connector means to fixedly connect the closure member to the base member such that the first and second flange members are arranged in spaced, parallel relation and in assembled position hold the ribbon holder in position about the hub.

More particularly, in accordance with the present invention, the first connector means is comprised of four posts spaced equidistantly from each other about the inner wall of the hub, each post having an aperture arranged in the axial line of the hub and formed with an external part-cylindrical surface; and the second connector means is comprised of four pins extending from the second flange member, each pin matingly engaging within the aperture of a respective post.

Further, the spool adapter means which may be of plastic material includes, one pair of diametrically opposed gripping members, each gripping member having an arcuate configuration for engaging the part-cylindrical outer surface of a respective post, whereby the spool adapter means is fixed at a predetermined position within the hub such that a central section thereof which connects the gripping members and which has a central aperture will resiliently deform upon the insertion of any size spindle within the central aperture thereof.

The above, and other, objects, features and advantages of the present invention will become readily apparent from the following detailed description thereof which is to be read in connection with the accompanying drawings.

DETAILED DESCRIPTION OF A PREFERRED EMBODIMENT

Figure 11:
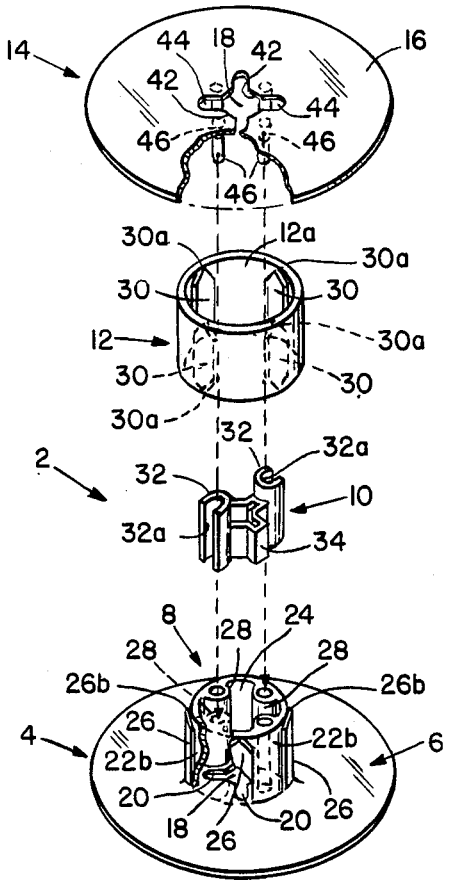
FIG. 11 is an exploded view, partly in section, of the universal spool shown in FIG. 1.

Referring to the drawings in detail, and initially to FIG. 11 thereof, a universal spool 2 according to one embodiment of the present invention is formed generally of a base member 4 including a first flange member 6, and a centrally disposed annular hub 8 secured to flange member 6; a resilient spool adapter 10 positioned within hub 8; an annular ribbon holder 12 positioned about hub 8; and a closure member 14 including a second flange member 16. The closure member 14 is secured to hub 8 as hereinafter more fully described so that the first and second flange members 6 and 16 are arranged generally in spaced, parallel relation in assembled position as shown in FIGS. 1 to 4 of the drawings.

Figure 4:
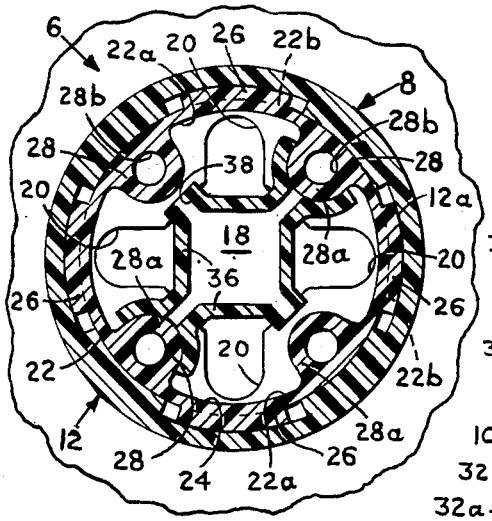
FIG. 4 is a cross-sectional view of the spool of FIG. 2, taken along line 4—4 thereof.
Figure 5:
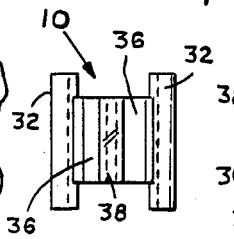
FIG. 5 is a front elevational view of the spool adapter for the universal spool shown in FIG. 1.
Figure 6:
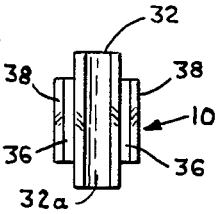
FIG. 6 is a side elevational view of the spool adapter shown in FIG. 5.

More particularly, and with reference to FIGS. 4 and 11, first flange member 6 has a substantially flat, annular configuration, with a central aperture 18 which opens into four elongated, radially directed slots 20, equidistantly spaced about central aperture 18. As a result, slots 20 form an "x shaped" opening in first flange member 6.

Annular hub 8 is integrally secured on first flange member 6 and formed generally of an upstanding hollow, thin-walled cylindrical section 22 which is centrally positioned at one end thereof about the elongated slots 20 on flange member 6, as shown in FIGS. 2–4 and 11. As a result, the inner wall 22*a* of cylindrical section 22 defines an opening 24 extending end-to-end therethrough in general alignment with such slots.

A plurality of splines 26 are formed integrally on the outer wall 22*b* of cylindrical section 22. More particularly, splines 26 are equidistantly spaced about outer wall 22*b* of cylindrical section 22 and extend substantially along the height of cylindrical section 22 of hub 8. Preferably, each spline 26 has an inverted-V configuration at the upper end thereof, as at 26*a*, with the point 26*b* of the inverted-V configuration pointing away from first flange member 6, the purpose of which will be readily apparent from the discussion hereinafter. Although only four splines 6, are shown in the FIGURES, those skilled in the art will readily recognize that the exact number, spacing and dimensions of the splines may vary without departing from the scope of the present invention.

Figure 3:
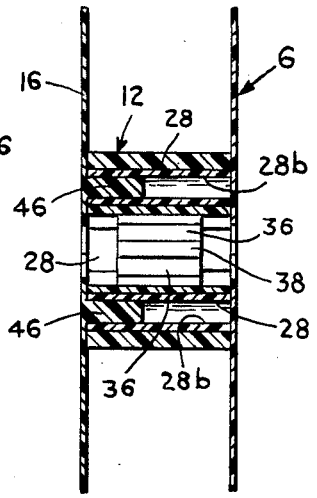
FIG. 3 is a cross-sectional view of the spool of FIG. 1, taken along line 3—3 thereof.

Referring now to FIGS. 3, 4 and 11, a plurality of connector sections 28 in the form of posts having part-cylindrical exterior surfaces 28*a* are integrally formed along inner wall 22*a* of cylindrical section 22. As with splines 26, connector sections 28 are equidistantly spaced about inner wall 22*a*. In order to provide greater structural re-enforcement of the thin-walled cylindrical section 22, connector sections 28 are preferably formed between adjacent splines, whereby the combined effect of splines 26 and connector sections 28 is to increase the overall thickness, and therefore the general rigidity, of cylindrical wall 22. As shown in the FIGURES, each post 28 has an aperture 28*b* arranged longitudinally and substantially centrally therein in the axial line of hub 8, the purpose of which will be readily apparent from the discussion hereinafter set forth. Apertures 28*b* open at the free ends of posts 28 and may extend only part way through the post or along the entire post, as shown, for example, in FIG. 3.

Preferably, base member 4, including first flange member 6 and hub 8, along with splines 26 and posts 28, are molded or formed integrally from any suitable type of plastic material.

Referring now to FIGS. 4, 9, 10 and 11, ribbon holder 12 is formed in a thin-walled cylindrical configuration having an inner wall 12*a* with a diameter substantially equal to or slightly greater than the resultant diameter formed by splines 26, whereby ribbon holder 12 can be positioned about hub 8.

Figure 2:
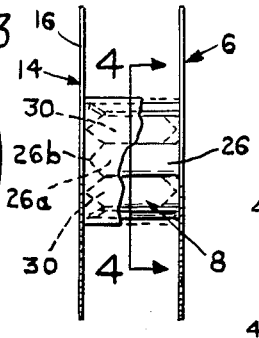
FIG. 2 is an elevational view of the spool of FIG. 1.

A plurality of splines 30 are formed along the inner wall 12*a* of ribbon holder 12 and, as with splines 26, are equidistantly spaced thereon. Generally, the number of splines 30 will be equal to the number of splines 26, although the number may vary in accordance with the present invention. It is important that splines 30 be formed on inner wall 12*a* such that, when ribbon holder 12 is positioned about hub 8, splines 30 are positioned between respective adjacent splines 26, as shown in FIGS. 2 and 4. In this manner, ribbon holder 12 is prevented from rotating about hub 8 when in assembled position thereon.

Ribbon holder 12 is symmetrical, and each spline 30 is formed with a V-shaped configuration 30*a* at both ends thereof which point toward the end edges of ribbon holder 12. As a result, V-shaped sections 30*a* cooperate with V-shaped sections 26*a* so that positioning of ribbon holder 12 on hub 8 automatically positions splines 30 between respective adjacent splines 26 on hub 8. Further, splines 30 have a thickness substantially equal to the thickness of splines 26 as shown in FIG. 4.

With this arrangement, a typewriter ribbon (not shown) can be easily and readily wound about ribbon holder 12. For example, a piece of tape may initially secure one end of the typewriter ribbon to ribbon holder 12, with the ribbon thereafter being wound thereabout. As a result, the ribbon winding operation can be performed independently of the remainder of the spool, with the ribbon holder having the typewriter ribbon being wound separately thereon and then later formed with the remainder of spool 2 during an assembling operation.

By winding the ribbon holder 12 separate from the remainder of the spool, a plurality of ribbon holders 12 can be simultaneously wound from a web of ribbon material. For example, for a web of material 18" wide, thirty-six ribbon holders 12 each having a diameter of ½" can be arranged in two rows on upper and lower shafts, with the web being slit by a slitter, and the slit sections of ribbon being wound on the respective holders 12.

Referring now to FIGS. 4–8 and 11, spool adapter 10 is formed of two diametrically opposed gripping members 32 connected together by a central resilient section 34. More particularly, each gripping member 32 is formed in an elongated half-cylindrical configuration extending in the heightwise direction of hub 8 and having a length substantially equal to the height of hub 8. Each gripping member 32 has its half-cylindrical configuration opening away from central section 34, whereby the inner wall 32*a* of each gripping member 32 engages the part-cylindrical exterior surface 28*a* of a respective post 28. As a result, spool adapter 10 is positioned within hub 8 in a fixed relationship, that is, spool adapter 10 is prevented from rotating therein due to the engagement of gripping members 32 with posts 28, and is prevented from moving in the longitudinal or heightwise direction of hub 8 since gripping members 32 and hub 8 are effectively of the same height.

Center section 34 of the spool adapter 10 includes, four side walls 36 effectively formed in a diamond or square configuration, with two diametrically opposed corners being connected to the exterior surfaces of opposing gripping members 32, and the remaining corners being connected together by U-shaped connecting sections 38.

Figure 7:
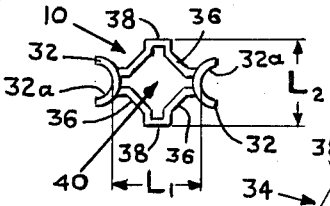
FIG. 7 is a top plan view of the spool adapter shown in FIG. 5.
Figure 8:
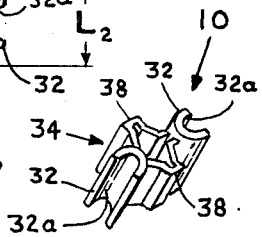
FIG. 8 is a perspective view of the spool adapter shown in FIG. 5.
Figure 9:
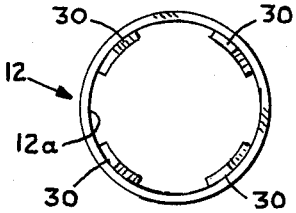
FIG. 9 is a top plan view of the ribbon holder of the universal spool shown in FIG. 1.
Figure 10:
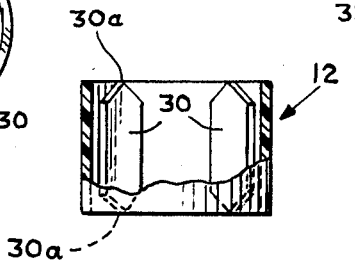
FIG. 10 is an elevational view, partly in section, of the ribbon holder shown in FIG. 9.

Further, center section 34 has a smaller height than gripping members 32 and is positioned midway along the height of the latter gripping members 32 so as to provide a symmetrical arrangement for the spool adapter 10. In addition, the widthwise or transverse dimension of spool adapter 10 along the line connecting gripping members 32, designated as $L_1$ in FIG. 7, is greater than the widthwise or transverse dimension $L_2$ in the direction substantially perpendicular thereto. As a result, as shown in FIG. 4, when spool adapter 10 is positioned within hub 8, such that gripping members 32 engage respective opposing posts 28, the U-shaped connecting sections 38 will be spaced from the remaining two posts 28. This will permit deformation of center section 34 when a spindle is inserted within the central aperture 40 defined between side walls 36, thereby enabling the spool adapter 10 to accommodate to the varying diameters of the typewriter spindles.

Figure 1:
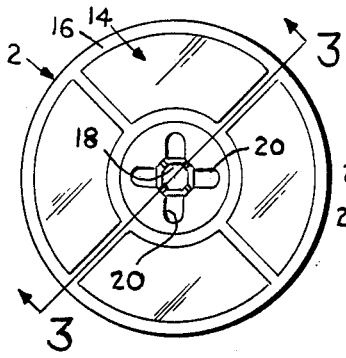
FIG. 1 is a top plan view of a universal spool according to one embodiment of the present invention.

Referring now to FIGS. 1, 3 and 11, it will be seen that second flange member 16 is formed in an identical configuration to first flange member 6, and is therefore formed with a central aperture 42 corresponding to aperture 18, and elongated slots 44, corresponding to slots 20, extending from aperture 42, so as to form an "x shaped" opening.

A plurality of pins 46 are formed during the molding of the closure or second flange member 16 so as to extend from the planar surface of second flange member 16 in a substantially perpendicular relation thereto. Pins 46 are equidistantly spaced relative the slots 44.

In the assembled configuration, as shown in FIG. 3, pins 46 extend within apertures 28*b* of posts 28 with a tight friction fit so as to fixedly connect the closure member 14 to base member 4. Pins 46 may be secured to second flange member 16 to provide an automatic breaking off of the pins if spool 2 is taken apart so as to prevent re-use thereof.

Preferably, all of the above mentioned parts are made of a plastic material so that each of the parts can be easily and readily molded.

In assembling spool 2, spool adapter 10 is first positioned within hub 8 such that gripping members 32 thereof engage respective posts 28 so as to fix spool adapter 10 within hub 8. Thereafter, ribbon holder 12 having a ribbon wound thereabout is inserted over hub 8 such that splines 30 are interposed between adjacent splines 26. Thereafter, spool adapter 10 and ribbon holder 12 are locked onto hub 8 by press fitting pins 46 within respective apertures 28*b* of posts 28, thereby also fixing closure member 14 onto base member 4 such that first and second flange members 6 and 16 are arranged in spaced, parallel relation.

With the universal ribbon spool according to the present invention, any size typewriter or the like spindle fits within central aperture 40 of the spool adapter 10 in a tight fitting relation, and the size of aperture in the spool adapter can readily vary depending on the required deformation of side walls 36 for a given spindle inserted therein. In addition, tabs commonly associated with the driving spindle engage respective slots 20 and/or 44 for rotatably driving spool 2. Still further, because central section 34 is of a lesser height than gripping members 32, a spindle, for example, of the type used with Olivetti machines, extends completely therethrough and can be threadibly engaged by a nut from the opposite side of spool 2. Accordingly, typewriter ribbon spool 2 according to the present invention is a truly universal spool.

Having described a specific preferred embodiment of the invention with reference to the accompanying drawings, it is to be understood that the present invention is not limited to that precise embodiment, and that various changes and modifications may be effected therein by one of ordinary skill in the art without departing from the scope and spirit of the present invention as defined by the appended claims.

What is claimed is:

1. A universal spool for ribbons comprising, a. a base member including, a first flange member, and a centrally disposed annual hub having an inner wall and an outer wall, said inner wall defining an opening extending end to end therethrough, b. spline means disposed on said outer wall of said annular hub, c. an annular ribbon holder having an inner wall defining an opening extending end to end therethrough and positioned about said hub, d. restraining means disposed on the inner wall of said ribbon holder for engagement with said spline means to prevent rotation of said ribbon holder about said hub, e. resilient spool adapter means positioned entirely within the opening of said hub and having a central section which defines a central opening, f. a first connector means disposed on the inner wall of said annular hub having at least one pair of posts, each post being positioned diametrically opposite the other post of said at least one pair of posts, and each post having an aperture arranged in the axial direction of said hub, g. at least two diametrically opposed gripping members disposed on said spool adapter means for mating engagement with said at least one pair of said posts, said mating engagement preventing substantial relative rotation between said annular hub and said resilient spool adapter means, h. a closure member including, a second flange member, and a second connector means centrally disposed on the closure member said closure member retaining said resilient spool adapter means within said opening of said hub, and i. said second connector means having at least one pair of pins disposed for mating engagement with the aligned apertures in said at least one pair of posts to fixedly connect said closure member to said base member such that the first and second flange members are arranged in spaced parallel relation.

* * * * *